United States Patent [19]

Gundlach et al.

[11] Patent Number: 4,963,738

[45] Date of Patent: Oct. 16, 1990

[54] FALT COMP-LIKE SCOROTRON CHARGING DEVICE

[75] Inventors: Robert W. Gundlach, Victor; Richard F. Bergen, Ontario, both of N.Y.

[73] Assignee: Xerox Corporation, Stamford, Conn.

[21] Appl. No.: 945,044

[22] Filed: Dec. 22, 1986

[51] Int. Cl.[5] ..... H01T 19/04; G03G 15/02

[52] U.S. Cl. ..... 250/326; 250/325; 361/229; 355/224

[58] Field of Search ..... 250/325, 326, 423 R; 361/229; 355/3 CH, 224

[56] References Cited

U.S. PATENT DOCUMENTS

| | | | |
|---|---|---|---|
| 2,836,725 | 5/1958 | Vyverberg | 250/49.5 |
| 2,879,395 | 3/1959 | Walkup | 250/49.5 |
| 3,624,392 | 11/1971 | Kurahashi et al. | 250/326 |
| 3,717,801 | 2/1973 | Silverberg | 317/262 E |
| 4,057,723 | 11/1977 | Sarid et al. | 250/326 |
| 4,086,650 | 4/1978 | Davis et al. | 361/229 |
| 4,153,836 | 5/1979 | Simm | 250/325 |
| 4,174,170 | 11/1979 | Yamamoto et al. | 355/2 T |
| 4,339,782 | 7/1982 | Yu et al. | 361/229 |
| 4,341,463 | 7/1982 | Kashiwagi et al. | 355/14 CH |
| 4,353,970 | 10/1982 | Dryczynski et al. | 430/31 |
| 4,495,508 | 1/1985 | Tarumi et al. | 346/159 |
| 4,511,244 | 4/1985 | Baumeister | 355/14 FU |
| 4,562,447 | 12/1985 | Tarumi et al. | 346/159 |
| 4,591,713 | 5/1986 | Gundlach et al. | 250/326 |

FOREIGN PATENT DOCUMENTS

| | | |
|---|---|---|
| 102569A | 3/1984 | European Pat. Off. . |
| 59-58453 | 4/1984 | Japan . |

*Primary Examiner*—Jack I. Berman

*Attorney, Agent, or Firm*—William A. Henry

[57] ABSTRACT

A charging device having a coronode that includes a comb-like ruthenium glass electrode silk screened onto a supporting dielectric substrate. The teeth of the comb-like electrode extend to an edge of the dielectric substrate and positionable relative to a screen or slit in several ways in order to form scorotron type devices.

25 Claims, 3 Drawing Sheets

FLAT COMB-LIKE SCOROTRON CHARGING DEVICE

Reference is hereby made to commonly assigned copending applications, Ser. No. 06/945,055 of Robert W. Gundlach et al., filed Dec. 22, 1986 and entitled "D. C. Flat Corona Charging Device", now abandoned, and Ser. No. 06/945,043 of Robert W. Gundlach et al., filed Dec. 22, 1986 and entitled "A. C. Compact Scorotron Charging Device", now abandoned each of which are incorporated herein by reference.

The present invention relates to a scorotron charging device for depositing charge on an adjacent surface. More particularly, it is directed to a flat comb-like scorotron corona charging arrangement usable in a xerographic reproduction system for generating a flow of ions onto an adjacent imaging surface for altering or charging the electrostatic charge thereon.

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to precharging the imaging surface of a xerographic system prior to exposure, corona devices are used to perform a variety of other functions in the xerographic process. For example, corona devices aid in the transfer of an electrostatic toner image from a reusable photoreceptor to a transfer member, the tacking and detacking of paper to the imaging member, the conditioning of the imaging surface prior to, during, and after the deposition of toner thereon to improve the quality of the xerographic copy produced thereby.

Both D.C. and A.C. type corona devices are used to perform many of the above functions.

The conventional form of corona discharge device for use in reproduction systems of the above type is shown generally in U.S. Pat. No. 2,836,725 in which a conductive corona electrode in the form of an elongated wire is connected to a corona generating D.C. voltage. The wire is partially surrounded by a conductive shield which is usually electrically grounded. The surface to be charged is spaced from the wire on the side opposite the shield and is mounted on a grounded substrate. Alternately, a corona device of the above type may be biased in a manner taught in U.S. Pat. No. 2,879,395 wherein an A.C. corona generating potential is applied to the conductive wire electrode and a D.C. potential is applied to the conductive shield partially surrounding the electrode to regulate the flow of ions from the electrode to the surface to be charged. Other biasing arrangements are known in the prior art and will not be discussed in great detail herein.

Several problems have been historically associated with such corona devices. A first problem has been the inability of such devices to deposit relatively uniform negative charge on an imaging surface.

More specifically, when a corona electrode in a device of the above type is biased with a negative corona generating potential, the charge density varies greatly along the length of the wire resulting in a corresponding variation in the magnitude of charge deposited on associated portions of an adjacent surface to be charged. This problem is visually verified as glow spots along the length of the corona wire when negative corona potentials are applied as contrasted to the more uniform corona glow when positive potentials are applied. More basically, the nonuniformity is believed to result from the fact that negative corona is initiated by high field stripping of electrons from the surface of the wire and sustained in large measure by secondary emission processes at the surface. This secondary emission process is easily affected by surface contamination which typically occurs from chemical growths on these surfaces. Positive ion bombardment also is believed to contribute to the nonuniformity problem by partially cleaning portions of the wire, which cleaned portions become emitters of relatively high current with respect to the remainder of the wire.

Other problems include singing and sagging of corona wire, contamination of corona wires, and costly manufacture of corona devices and humidity effects on corona devices causing inconsistant corona performances.

Various approaches to answering these problems have been tried in the past. For example, U.S. Pat. No. 4,086,650 suggests the use of a corona discharge device that includes an A. C. corona discharge electrode located adjacent a conductive shield with the electrode being covered with relatively thick dielectric material so as to substantially prevent the flow of conduction current therethrough. The delivery of charge to a photoconductive surface is accomplished by means of displacement current or capacitance coupling through the dielectric material. European Patent Application EP No. 102-569-A shows a large variety of corotrons with wire shaped corona discharge electrodes 3, 4 and 5 in FIG. 3 disposed on the surface of a cylinder. U.S. Pat. No. 4,353,970 discloses a bare wire coronode attached directly to the outside of a glass coated secondary electrode in FIG. 5. Point coronodes are shown in an electrode arrangement in FIG. 10 with their points sticking out away from between two glass plates. A corona discharge electrode in contact with or closely spaced from a conductive shield electrode is shown in U.S. Pat. No. 4,057,723. The discharge electrode includes a conductive wire coated with a relatively thick dielectric material. The dielectric is preferably glass, but can be an organic dielectric. U.S. Pat. No. 4,341,463 discloses two sets of wire coronodes with shields spaced equidistantly around each coronode. The two sets of coronodes are spaced in parallel and not in alternating fashion. In U.S. Pat. No. 4,339,782, a barb coronode with a ring shaped shield spaced equidistantly around the barb tip is shown. The shield is perpendicular to the barb and not in the same plane as the barb. U.S. Pat. No. 4,591,713 discloses a barb coronode with a shield perpendicular to the barb. In U.S. Pat. No. 3,717,801, column 6, lines 10–12, coronodes of a shieldless corotron are disclosed as taking the form of thin conductive strips which are suitably painted or etched on an appropriate insulating material such as glass or plastic. U.S. Pat. No. 4,511,244 discloses cleaning a corona wire by generating resistance heating through applying a small EMF directly to the coronode. In Japanese Patent No. 59-58453 suggests placing a resistor on the back side of a shield which supports a coronode, thereby to heat the air around the coronode and a photosensitive surface being charged in order to try and stabilize the electrified state on the photoreceptor.

Other attempts at answering the above-mentioned problems include U.S. Pat. No. 4,495,508 which discloses an electrostatic reproducing apparatus that includes a condensing electrode disposed between a corona ion generator and an ion modulating electrode. In one instance, the condensing electrode is divided into two portions, each separately charged by a D.C. power supply and separated by a distance of 0.2 to 1.0 mm. Dividing the condensing electrode allows for the deflection of the corona flow and an increase in the density of the ions. In U.S. Pat. No. 4,174,170 a pair of shield elements are shown in a conductive toner transfer machine that define an opening through which corona ions pass. The width of the opening is between 3 and 5 mm. An ion modulating electrode is disclosed in U.S. Pat. No. 4,562,447 that has a plurality of apertures capable of enhancing or blocking the passage of a corona ion flow through the apertures. All references referred to herein are incorporated by reference to the extent necessary to practice the present invention. Although these attempts at solving the above-mentioned charging problem have had some success, they have not been entirely satisfactory.

Accordingly, a flat comb-like scorotron charging device is disclosed that is stable in changing humidities and operable at much lower voltages and comprises a comb-like electrode which extends to an edge of an insulating support substrate. A control electrode is spaced closely adjacent to the edge of and forms a slit in combination with the support substrate. Ions from the comb-like electrode are forced between the slit onto the top surface of a charge retentive member.

The foregoing and other features of the instant invention will be more apparent from a further reading of the specification, claims and from the drawings in which:

Figure 1:
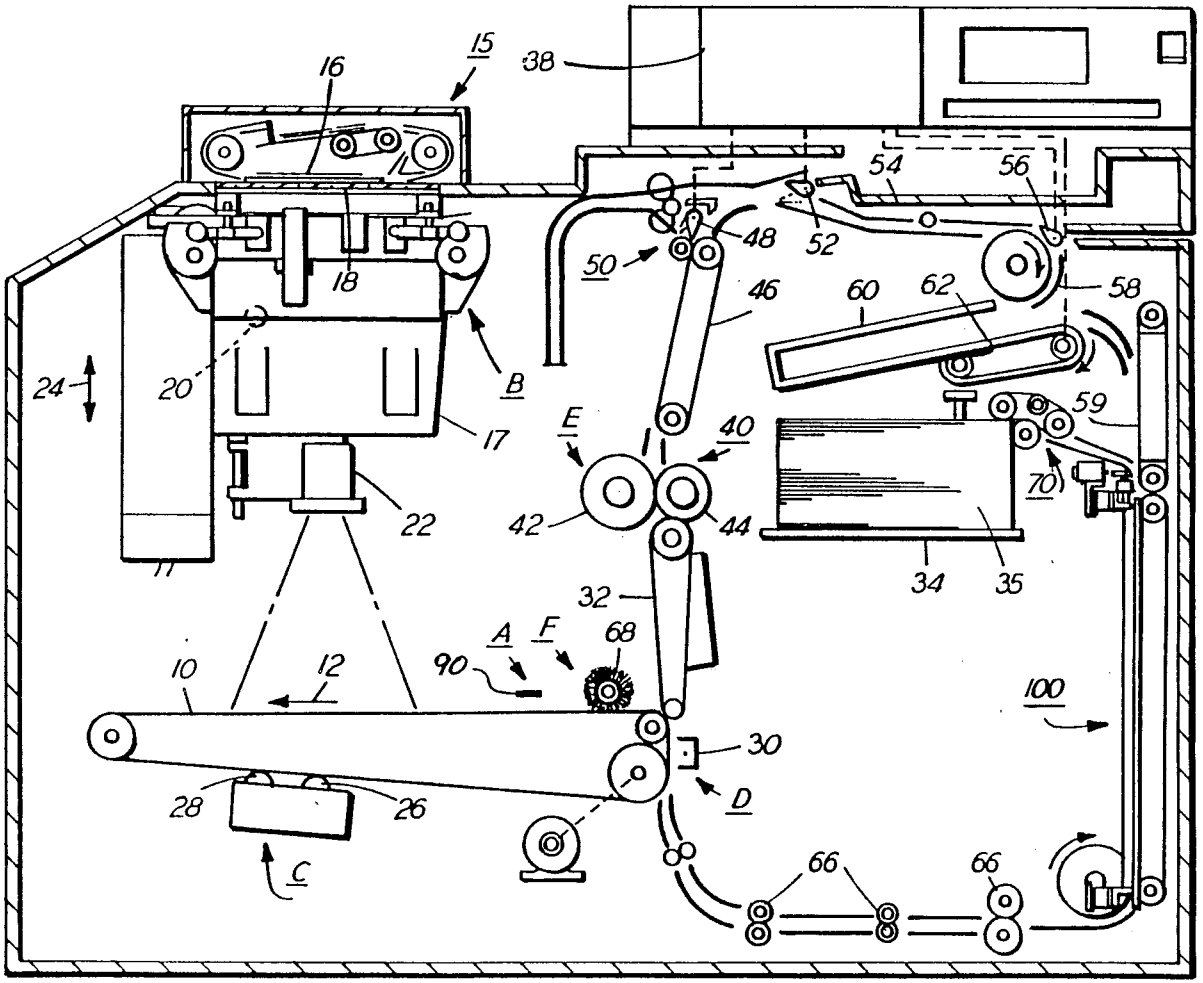
FIG. 1 is a schematic elevational view showing an electrophotographic copier employing the features of an aspect of the present invention.

For a general understanding of the features of the present invention, reference is had to the drawings. In the drawings, like reference numerals have been used throughout to designate identical elements. FIG. 1 schematically depicts the various components of an illustrative electrophotographic copying machine incorporating the improved flat scorotron apparatus of the present invention therein.

Inasmuch as the art of electrophotographic copying is well known, the various processing stations employed in the FIG. 1 copying machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device in accordance with the present invention, indicated generally by the reference numeral 90, charges the photoconductive surface to a relatively high substantially uniform potential.

Next, the charged portion of the photoconductive surface is advanced through imaging station B. At imaging station B, a document handling unit indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the information areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a copying or printing machine which does not include a document handling unit, or when one is making copies of A3 or 11"×17" documents where the document handler has to be raised up from the platen and the oversized document manually placed on the platen for copying.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from tray 34 to transfer station D. The tray senses the size of the copy sheets and sends an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carries it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed to conveyor 59 seriatim by bottom feeder 62 back to transfer station D for transfer of the toner powder image to the opposed side of the sheet. Conveyors 100 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with the photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

Turning now to an aspect of the present invention, the wide spread belief is that as an insulting surface approaches a corona wire, it collects charge, builds up its potential, and suppresses the potential gradients around the wire, thereby shutting down corona. In fact, in the right configuration, the fields can be made to prevent ion deposits on the insulating surface so that its potential does not build up enough to surpress corona substantially. Charges opposite in polarity to the applied potential on the insulating surface can deposit about a wire tip, so that strong potential gradients are maintained to reinforce corona generation. A charging device of this type carries all conducting elements in one plane, namely, on the surface of a printed circuit board, glass or alumina. For negative corona, the coronode can be shaped to have comb-like points to give corona beads at controlled regular intervals. Since the coronode-to-shield spacing can be reduced, (because sagging or singing problems are precluded, and arcing is eliminated) the corona points can be made closer together, for example, on about 5 to about 100 mil centers or so. This carries significant advantages of ease of manufacture (no stringing and tensioning of fine wires), unlimited length without sagging or singing of wires, durability (no fragile wires to break), easy maintenance (a single surface can be cleaned with alcohol) and substantially diminishing the effects of humidity on charging performance.

Figure 2:
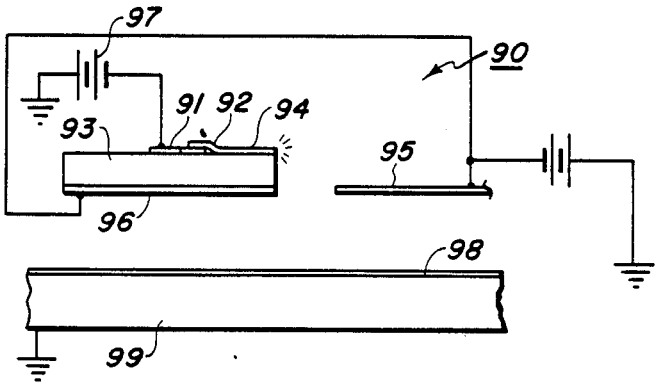
FIGS. 2 and 2A show a side view and plan view, respectively, of the flat corona device of FIG. 1 and the present invention employed as the charging unit.
Figure 2A:
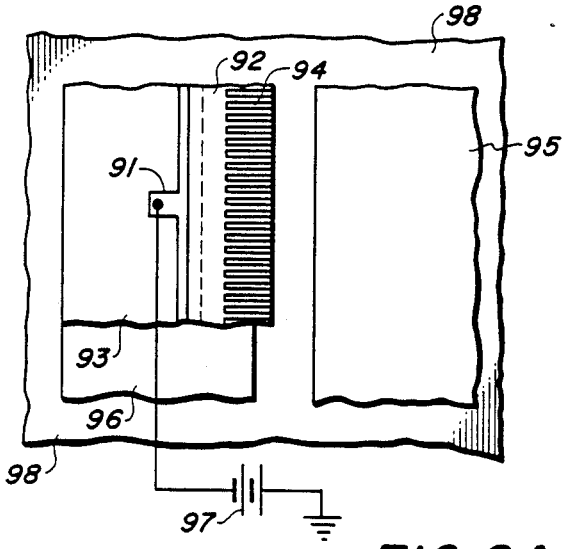

In reference to FIGS. 1,2 and 2A, a flat scorotron positioned in a horizontal plane is shown as 90 that comprises high voltage at 97, e.g. 5000 kV, bus bar 91 connected to a comb-like corona lines 94 through a resistor member 92 that includes ruthenium oxide in a ceramic or glass binder. A screen or reference electrodes 95 and 96 are disclosed for potential leveling purposes and have a low voltage, e.g. −1000 kV applied to them. The preferred coronode is ruthenium-glass, screen printed and fixed on the corona resistant substrate 93 such as high temperature glass, ceramic or alumina. A unique aspect of this invention is the extention of coronode lines 94 to an edge or outside corner of insulating substrate 93. This edge of coronode tips is mounted about 1 to 2 mm from reference electrode 95 and forms a slit with the reference electrode through which ions pass directed toward photosensitive surface 98 mounted on grounded conductive support member 99. As seen clearly in FIGS. 2 and 2A, comb-like ruthenium glass lines 94 are mounted on a flat piece of alumina 93 having a thickness of 0.5 mm with lines 94 extending to an edge or sharp outside corner of the alumina that is spaced approximately 1–2 mm from charge control reference electrode 95, preferably 1 mm. Another metal reference electrode 96 is positioned on the bottom surface of the alumina and is spaced approximately 1–2 mm and preferably 1.5 mm away from charge retentive surface 98. Ordinarily, a negative voltage of ~5000 V D.C. is applied from high voltage source 97 to bus bar electrode 91 contacting resistor member 92, and since each tip of comb-like lines 94 is on an insulating substrate 93, they act as stand alone resistors. The high resistance of each coronode member 94 limits arcing currents, and also serves to make corona current output more uniform, since the drop in potential between the bus bar and the corona tips is the product of the current and resistance ($\Delta V \times IXR$) of each coronode member 94. The tips of comb-like lines 94 have been shown to be at a very high spatial frequency. Tips 0.003 inches wide and positioned on 7 mil centers have been shown to produce corona. Usually, metal electrodes 95 and 96 are biased to about −1000 kV for maximum charging efficiency of scorotron device 90. Metal tips this close on center would shut themselves off due to the voltage gradient about each tip being reduced due to the presence of the bias on the adjacent tips. Typically, metal tips in air are 2–3 mm on center. If we consider only the bulk conductivity of the supporting glass or alumina structure 93, we should expect the corona generating fields to collapse as charges conduct over time to bring the entire substrate 93 to the potential applied to the bus bar 92. However, as long as some of the lines of force emitting from the coronodes 94 exit thru insulating substrate 93 into the ionized air, they will attract ions opposite in polarity to the applied potential, depositing them on the substrate 93 between corona emitting lines 94, and enhancing the potential gradients around each coronode tip in a self-sustaining process.

Figure 3:
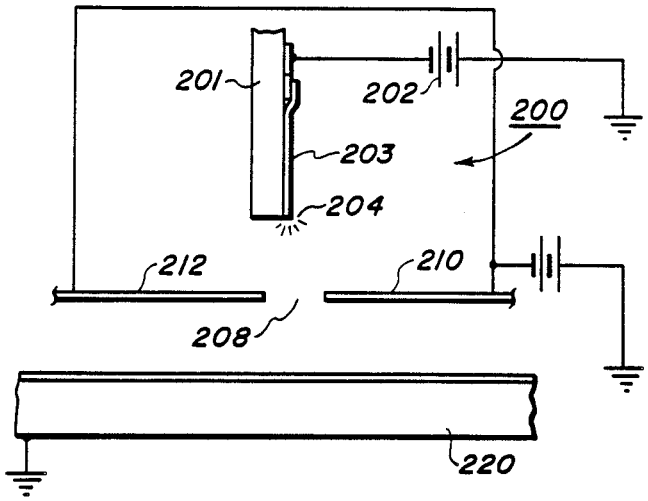
FIG. 3 is an alternative embodiment of the present invention that shows a flat corona device mounted vertically with respect to a charge retentive surface.

An alternative embodiment of a flat scorotron 200 in accordance with the present invention is shown in FIG. 3 and comprises corona generator of ½ mm thick piece of alumina 201 with a ruthenium comb 203 stenciled on the right side of the alumina as viewed in the Figure. The alumina is positioned vertically about 3 mm away from a photosensitive member 220, that is adapted to move in a horizontal plane in relation to ruthenium comb 203. Teeth of ruthenium comb 203 extend to the edge 204 of alumina member 201 where corona takes place as a result of electrostatic potential being applied from negative high voltage source 202. Separate charge control electrodes 210 and 212 are positioned in a horizontal plane about 1–2 mm and preferably 1.5 mm away from both the end of alumina member 201 and grounded photosensitive member 220. A low negative voltage is applied to both electrodes 210 and 212 in order to control the charge level placed on the top surface of photosensitive member 220. Metal electrodes 210 and 212 could be replaced with a single screen if desired. However, as shown, electrodes 210 and 212 form a slit 208 of approximately 1–2 mm through which ions from comb 203 are directed toward photosensitive member 220.

Figure 4:
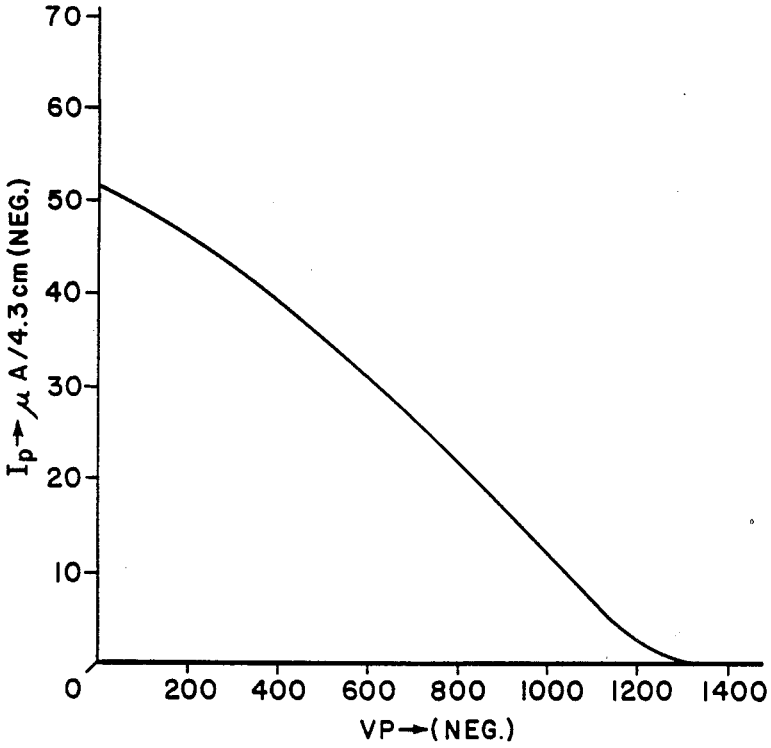
FIG. 4 is a graph showing the relationship between voltage on a bare plate and current to the bare plate.

In reference to the graph shown in FIG. 4, it shows that the device of the present invention can be operated in scorotron fashion, that is, a controllable voltage is applied to an insulating receiver. Plate current ($I_p$) is plotted versus Plate voltage ($V_p$) with the voltage of the slit ($V_{slit}$) equal to about −1000 V and the current $I_c$ equal to about 100 μA. As shown, the voltage difference gets smaller and smaller as the surface potential builds up in the receiver plate. Eventually, no current will flow to the receiver plate as it reaches its asymptote voltage. On the graph, the asymptote is about 1250 V with about 1000 V applied to the slit. The slit voltage is nearly the asymptote of the receiver plate.

It should now be apparent that a novel charging device is disclosed in which the coronode consists of an electrode extending to the edge of a supporting dielectric. This "coronode unit" can be positioned relative to a screen in several ways to form scorotron type devices. The essential and distinguishing feature of this concept is that some electric field lines pass through and emerge from the edge face of the dielectric. Ions of opposite polarity originating in the air deposit on this surface very close to the coronode electrode edge, creating potential wells close to the coronode electrode. Ions of the same polarity as the coronode electrode cannot collect to shut off corona. Multiple electrodes can be formed on a flat dielectric substrate, creating an array of charging elements. The opposite polarity of charge deposited about each coronode electrode serves to isolate the coronodes from each other. Further, this device is much more stable in high humidity environments than charging devices of the past.

While this invention has been described with reference to the structures disclosed herein, they are not confined to the details as set forth and are intended to cover modifications and changes that may come within the scope of the following claims.

What is claimed is:

1. A charging device adapted to apply a uniform charge to a charge retentive surface, comprising:

a corona resistant dielectric support substrate;

ruthenium oxide in a glass or ceramic binder corona producing means extending to an edge of said dielectric support substrate and adapted to produce corona at said edge; and high voltage means connected to said corona producing means and adapted to apply sufficient voltage to said corona producing means that corona ions are emitted from said corona producing means at said edge of said dielectric support substrate.

2. The charging device of claim 1, including a pair of reference electrodes forming a slit adapted to control the charge level placed on said charge retentive surface by said corona producing means.

3. The charging device of claim 2, wherein said reference electrodes form a slit through which ions from said corona producing means travel toward said charge retentive substrate.

4. The charging device of claim 3, wherein said reference electrodes have low voltages applied thereto.

5. The charging device of claim 4, wherein said corona producing means and said dielectric support substrate extend in an approximately vertical plane while said charge retentive substrate extends in an approximately horizontal plane.

6. The charging device of claim 4, wherein said dielectric support substrate and said charge retentive substrate are both in horizontal planes.

7. The charging device of claim 2, wherein said corona producing means is positioned on the surface of the outside corner of said dielectric support substrate most remote from said charge retentive surface.

8. The charging device of claim 2, wherein said pair of reference electrodes form a slit for the passage of ions from said corona producing means therethrough, said pair of reference electrodes being positioned between 1–2 mm and preferably 1.5 mm away from both said dielectric support substrate and said charge retentive surface.

9. The charging device of claim 8, wherein said slit is between 1–2 mm and preferably 1 mm in width.

10. The charging device of claim 1, in which said corona producing means is (screen printed and fixed on) integral with said corona resistant dielectric substrate.

11. The charging device of claim 1, wherein said corona producing means has a comb-like configuration with teeth of the comb extending to said edge of said dielectric substrate.

12. The charging device of claim 1, including screen means that is adapted in conjunction with said corona producing means and the charge retentive surface to produce potential wells within the screen and thereby provide control of the charge placed on said charge retentive substrate.

13. The charging device of claim 12, wherein said screen means has a low voltage applied thereto.

14. The charging device of claim 1, wherein said ruthenium oxide has a resistance in the range of $10^5$–$10^9\Omega/cm^2$ and a preferred resistance of $10^8\Omega/cm^2$ for a comb-like member having a 20 to 1 length to width ratio.

15. The charging device of claim 1, including reference electrode structure through which the corona generated ions must pass to produce a uniform surface potential on said charge retentive surface.

16. The charging device of claim 15, wherein said reference electrode structure is a conducting screen.

17. A charging device adapted to apply a uniform charge to a charge retentive surface, comprising:

a dielectric support substrate;

corona producing means extending to an edge of said dielectric support substrate and adapted to produce corona at said edge;

a pair of reference electrodes forming a slit adapted to control the charge level placed on said charge retentive surface by said corona producing means, and wherein one of said pair of reference electrodes is integral with said dielectric support substrate; and high voltage means connected to said corona producing means and adapted to apply sufficient voltage to said corona producing means that corona ions are emitted from said corona producing means at said edge of said dielectric support substrate.

18. The charging device of claim 17, wherein said reference electrodes form a slit through which said ions from said corona producing means travel toward said charge retentive substrate.

19. The charging device of claim 17, wherein said one of said pair of reference electrodes that is integral with said dielectric support substrate is directly adjacent the top surface of said charge retentive surface.

20. The charging device of claim 17, wherein said one of said pair of reference electrodes comprises conducting ceramic material resistant to by-products of corona.

21. A corona ion source, comprising:

an insulating, corona tolerant substrate;

a resistive comb-like member mounted on said substrate with teeth extending to one edge of said substrate; and a high voltage means adapted to apply a voltage to said comb-like member in order to create corona at the tips of said teeth.

22. The corona ion source of claim 21, including reference electrode means adapted in combination with ions from said resistive comb-like member to produce potential wells close to said reference electrode means in order to control the ion level on a receptor surface.

23. The charging device of claim 21, wherein said comb-like member has teeth with tips that are adapted to act as stand alone resistors.

24. A charging device adapted to apply a uniform charge to a charge retentive surface, comprising:

a dielectric support substrate;

corona producing means extending to an edge of said dielectric support substrate and adapted to produce corona at said edge;

screen means that is adapted in conjunction with said corona producing means and the charge retentive surface to produce potential wells within the screen and thereby provide control of the charge placed on said charge retentive substrate, said screen means having a low voltage applied thereto and comprising two separate and individual screens that form a slit through which ions from said corona producing means pass; and high voltage means connected to said corona producing means and adapted to apply sufficient voltage to said corona producing means that corona ions are emitted from said corona producing means at said edge of said dielectric support substrate.

25. A charging device adapted to apply a uniform charge to a charge retentive surface, comprising:

a dielectric support substrate;

corona producing means extending to an edge of said dielectric support substrate and adapted to produce corona at said edge;

reference electrode structure including a pair of screens that form a slit for passage therethrough of said corona generated ions in order to produce a uniform surface potential on said charge retentive surface; and high voltage means connected to said corona producing means and adapted to apply sufficient voltage to said corona producing means that corona ions are emitted from said corona producing means at said edge of said dielectric support substrate.

* * * * *